US006065603A

United States Patent [19]

Filice et al.

[11] Patent Number: 6,065,603

[45] Date of Patent: May 23, 2000

[54] STACKABLE GLASS TUMBLERS

[75] Inventors: Umberto Filice, Dublin; Michael D. Shook, Lancaster, both of Ohio

[73] Assignee: Newell Operating Company, Freeport, Ill.

[21] Appl. No.: 09/227,708

[22] Filed: Jan. 8, 1999

[51] Int. Cl.[7] ..... B65D 21/02

[52] U.S. Cl. ..... 206/519; 206/217; 215/382

[58] Field of Search ..... 206/519, 217; 215/382

[56] References Cited

U.S. PATENT DOCUMENTS

| | | | |
|---|---|---|---|
| Re. 29,320 | 7/1977 | Kalata et al. . | |
| D. 89,562 | 3/1933 | Ilgenfritz . | |
| D. 90,082 | 6/1933 | Piazzoli . | |
| D. 113,230 | 2/1939 | Karstadt . | |
| D. 198,139 | 5/1964 | Edwards . | |
| D. 240,284 | 6/1976 | Sarpaneva . | |
| D. 305,966 | 2/1990 | DeMars . | |
| 795,437 | 7/1905 | Geuder . | |
| 2,858,041 | 10/1958 | Robinson | 206/519 |
| 2,879,917 | 3/1959 | Flack . | |
| 3,094,240 | 6/1963 | Wanderer . | |
| 3,139,213 | 6/1964 | Edwards . | |
| 3,347,411 | 10/1967 | Kalata et al. . | |
| 3,648,888 | 3/1972 | Cheladee | 206/519 |
| 3,721,367 | 3/1973 | Fletcher . | |
| 5,219,419 | 6/1993 | Prothe . | |
| 5,335,789 | 8/1994 | Taravella et al. . | |

OTHER PUBLICATIONS

Arcoroc—Forum Catalog page.

Libbey—pp. 40 and 41 of stemware, barware catalog, Gibraltar series.

Arcoroc—Stackables brochure.

Libbey—p. 45 of stemware, barware catalog, Everest series.

*Primary Examiner*—Joseph M. Moy

*Attorney, Agent, or Firm*—Foley & Lardner

[57] ABSTRACT

A stackable glass tumbler is disclosed having minimal contact between the outer surface of the upper tumbler with the inner surface of the lower tumbler, thus decreasing sticking between the stacked tumblers. The tumbler provides a desirable capacity to height ratio when stacked, and has a plurality of surfaces to which decorative material can easily be added.

17 Claims, 3 Drawing Sheets

STACKABLE GLASS TUMBLERS

FIELD OF THE INVENTION

This invention relates in general to drinking containers, and in particular to stackable glass tumblers.

BACKGROUND OF THE INVENTION

Drinking containers, such as cups or mugs, which nest or stack have generally been fabricated of lightweight material for a single or limited number of uses; for example, picnics and informal parties. Stacking ability is important for storage and transport, since the single or limited use of these articles typically requires transport and storage of large numbers of articles. Stacking considerations were primarily directed toward minimizing the stack height of the containers, which resulted in larger numbers of containers for a given stack height or space toward sufficient strength when the containers are packed to withstand transport and rough handling, and toward ease of dispensing the containers for use, i.e., the containers should not stick together or be so loosely stacked, that the bottom container would fall if the stack were lifted.

However, glass tumblers are fabricated of heavier and thicker material and are used repeatedly and often in a more formal setting. Such tumblers are most frequently stored upright in a single layer on a hard surface, such as a cupboard shelf. Alternatively, a more efficient means and common method of storing glass tumblers is to "stack" them by "pyramiding," which involves stacking an upper tier of tumblers upside down, or inverted, upon a lower tier of inverted tumblers, such that each upper tumbler is supported on its rim by the base of more than one lower tumbler. This method is stable and allows drainage and drying of the tumblers. Consequently, glass tumblers are generally designed on the basis of ease of use for drinking, for repeated use, and for aesthetic appeal, and not on the basis of storage space efficiency.

Currently, the use of machine washing usually results in glass tumblers which are completely dry before they are put away for storage. Furthermore, pyramiding tumblers is not the most efficient use of space, and is thus less useful for longer-term storage and for transport of large numbers of tumblers. Recently, glass tumblers which stack in a nesting fashion have become available. However, these tumblers have been designed on the bases described above, and suffer several drawbacks. One is that the stack height is relatively high; that is, the portion of the entire length of the tumbler which nests into the lower tumbler is relatively small. Another is that the tumblers are often top-heavy, so that stacks thereof may be unstable. Yet another is that the outer surface of the side walls of the upper tumbler often touches or rests against the inner surface of the side walls of the lower tumbler, resulting in an increased likelihood of the tumblers stacking with consequent damage to and breakage of the tumblers. Yet another drawback is that the side wall surface of currently available stackable glass tumblers are often curved or angled in an upright direction, such that ornamentation of the surface of the side walls of the glass tumblers with printed or other externally applied decorative material, such as logos, is difficult if not impossible.

BRIEF SUMMARY OF THE INVENTION

Therefore, it is a feature of the invention to provide stackable glass tumblers which have a desired capacity and which stack to yield a relatively low stack height. It is yet another feature of the invention to provide stackable glass tumblers which are not top heavy, and which result in stable stacks. It is yet another feature of the invention to provide stackable glass tumblers which stack such that the outer surface of the side walls of the upper tumblers do not touch and stick to the inner surface of the lower tumblers. It is a further feature of the present invention to provide glass tumblers which have relatively straight side wall surfaces which can be easily ornamented with printed or other externally applied decorative material. Because the outer surfaces of the tumblers are not in contact when stacked, such decorative material will last longer, as it is less likely to be damaged or rubbed off. Finally, the shape dictated by meeting these objectives results in an aesthetically attractive glass tumbler which results in a new look with very clean lines.

The features set out above are met generally by stackable glass tumblers having a large side wall area configured with a step to result in a tumbler of a good overall height which stacks to a low stack height and avoids significant surface contact of the glass side walls during stacking.

More particularly, the glass tumbler has the following components: a bottom having an upper and lower surface and a radial edge; a side wall extending upwardly therefrom, the side wall having a first side wall portion of a first length which extends upwardly and radially outwardly from the bottom at a first constant angle such that a lower end of the first side wall portion adjacent to the bottom has a smaller diameter than an upper end of the first portion; a shoulder or step which extends radially outwardly from the upper end of the first side wall portion, such that a lower end of the shoulder adjacent to the upper end of the first side wall portion has a smaller diameter than an upper end of the shoulder; and a second side wall portion of a second length which is less than the first length and which extends upwardly and radially outwardly from the upper end of the shoulder at a second constant angle which is less than the first constant angle, such that a lower end of the second side wall portion adjacent the shoulder has a smaller diameter than an upper end of the second side wall portion which defines an open mouth of the glass. The mouth includes a rim of sufficient edge width to engage the shoulder of a like configured glass tumbler stacked therewithin so that the outer surface of the first side wall portion of a like configured glass tumbler will not contact an inner surface of the glass tumbler when stacked coaxially therewith.

In a preferred embodiment, the length of the second side wall portion is about one half of the length of the first side wall portion; most preferably, the length of the second side wall portion is about 34% of the height of the tumbler. In another preferred embodiment, the angle of the first side wall portion is in the range of 7 to 11 degrees, and most preferably it is about 7 degrees. In another preferred embodiment, the angle of the second side wall portion in the range of 2 to 3 degrees and most preferably it is about 2 degrees.

In the preferred embodiment, the horizontal cross-section of the tumblers are generally circular, and the bottom of the tumbler has a thickness which is greater than the thickness of the side wall. In the most preferred embodiment, the thickness of the tumbler side wall increases in a downwardly direction from the mouth to the bottom wall, while the thickness of the bottom is greater than the thickness of the side wall.

In one embodiment, the tumbler side wall surface is substantially smooth. In another embodiment, the tumbler side wall is further characterized as having decorative material applied to either the inner or the outer surface of either the first portion, the second portion, or both portions of the side wall. In yet another embodiment, the tumbler side wall is further characterized as containing a three dimensional surface design.

BRIEF DESCRIPTION OF THE DRAWINGS

In the drawings; like reference numerals are used to indicate like components.

DETAILED DESCRIPTION OF THE INVENTION

Figure 1:
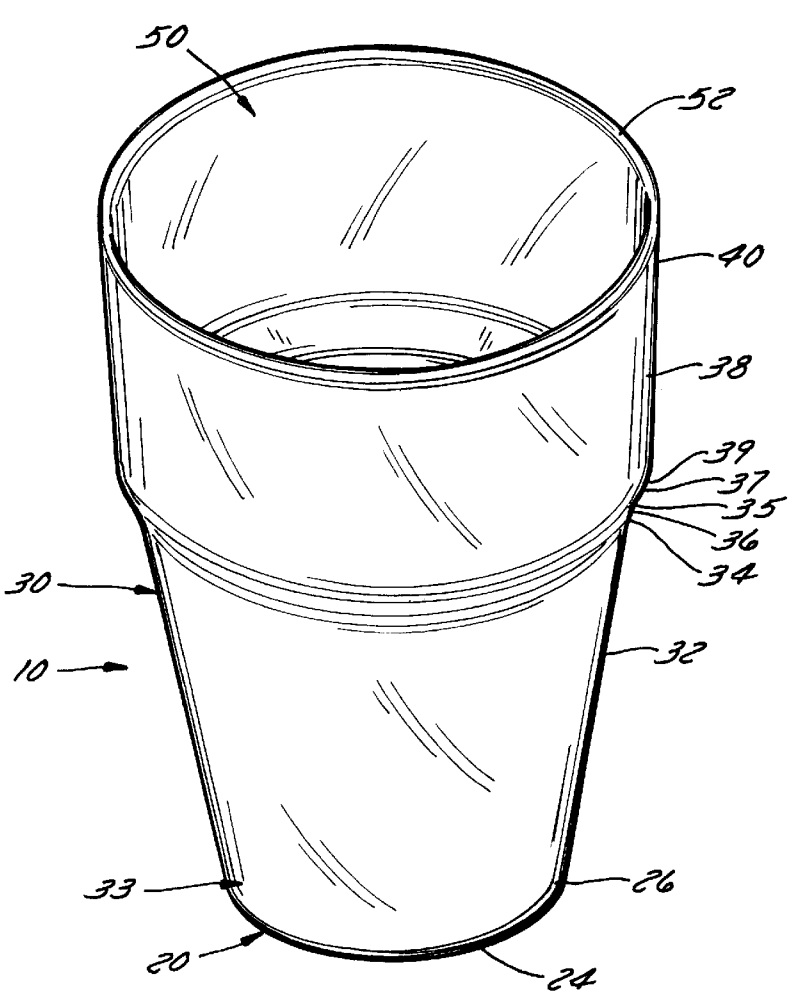
FIG. 1 is a perspective view of a preferred embodiment of a stackable glass tumbler of the present invention.
Figure 2:
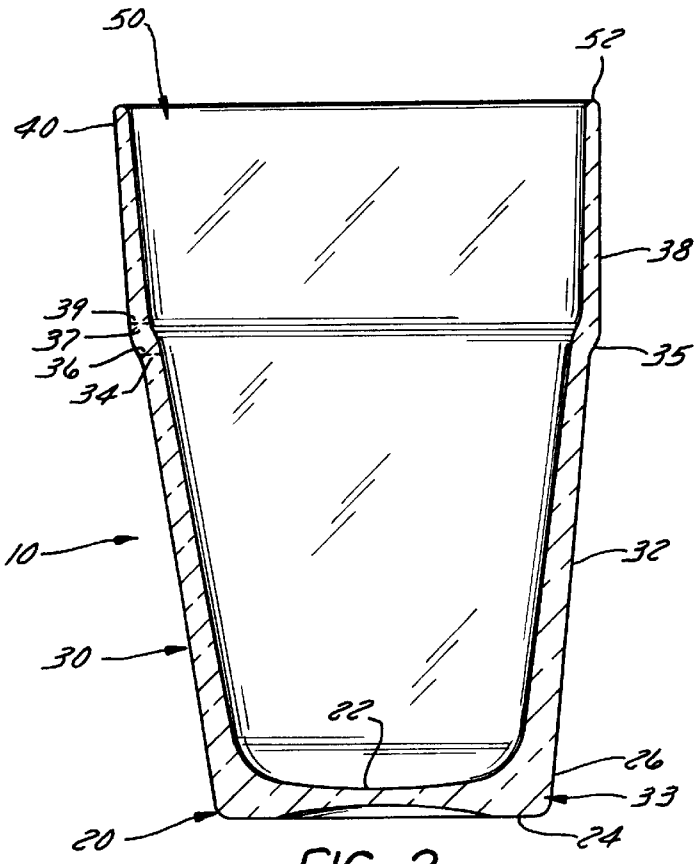
FIG. 2 is a schematic, vertical sectional side view of the stackable glass tumbler of FIG. 1.

With reference to the drawings, FIGS. 1 and 2 depict a stackable glass tumbler 10 of the invention. Glass tumbler 10 comprises a preferably circular bottom 20, a substantially smooth side wall 30, and an open mouth 50.

The bottom has a top inner surface 22, a bottom outer surface 24, and a radial edge 26. In this specification, the thickness of a wall of the tumbler will mean the distance between its inner surface and the outer surface. For the bottom 20, the thickness is the distance between the top inner surface 22 and the bottom outer surface 24, and it is generally greater than the thickness of any part of the tumbler side wall 30. This lends greater stability to the glass, both in use and when it is stacked.

The side wall 30 comprises a first side wall portion 32, a shoulder 35, and a second side wall portion 38. The first side wall portion 32 extends upwardly and radially outwardly from the radial edge 26 of the bottom 20 at a constant first angle. Therefore, the lower end 33 of the first side wall portion 32, which is adjacent to the bottom 20, has a smaller diameter than the upper end 34 of the first side wall portion 32. In this specification, the ends of a section of the side wall do not refer to or define separate pieces; rather, the ends refer to relative positions of the side wall sections for illustrative purposes only. The angle of the first side wall portion 32 is preferably in the range of about 7 to 13 degrees, and most preferably about 7 degrees, when measured from a longitudinal axis perpendicular to the bottom.

The shoulder 35 extends radially outward from the upper end 34 of the first side wall portion 32, so that the lower end 36 of the shoulder 35, which is adjacent to the upper end 34 of the first side wall portion 32, has a smaller diameter than does the upper end 37 of the shoulder 35. The length and angle of the shoulder 35 form a ledge of sufficient size to rest upon the rim of the mouth of a second tumbler, as will become more apparent as the description of the preferred embodiment continues.

The second side wall portion 38 extends upwardly and radially outwardly from the upper end 37 of the shoulder 35 at a second constant angle.

Accordingly, the lower end 39 of the second side wall portion 38, which is adjacent to the shoulder 35, has a smaller diameter than does the upper end 40 of the second side wall portion 38. This second angle is less than the first angle, which means that the second portion of the side wall 38 is more nearly perpendicular to the bottom 20 than is the first portion 32 of the side wall 32. The angle of the second side wall portion 38 is preferably in the range of about 2 to 6 degrees, and most preferably about 2 degrees, when measured from a longitudinal axis perpendicular to the bottom wall 20.

The length of the first side wall portion 32 is also greater than the length of the second side wall portion 38. Preferably, the length of the second side wall portion 38 is less than about one half of the length of the first side wall portion 32. Most preferably, the length of the second side wall portion 38 is about 34% of the total length of the side wall 30.

The upper end 40 of the second side wall portion 38 defines an open mouth 50 of the tumbler. The mouth 50 has a circular rim 52 with a sufficient width to engage the shoulder 35 of a like configured glass tumbler 10 stacked therewithin.

Figure 3:
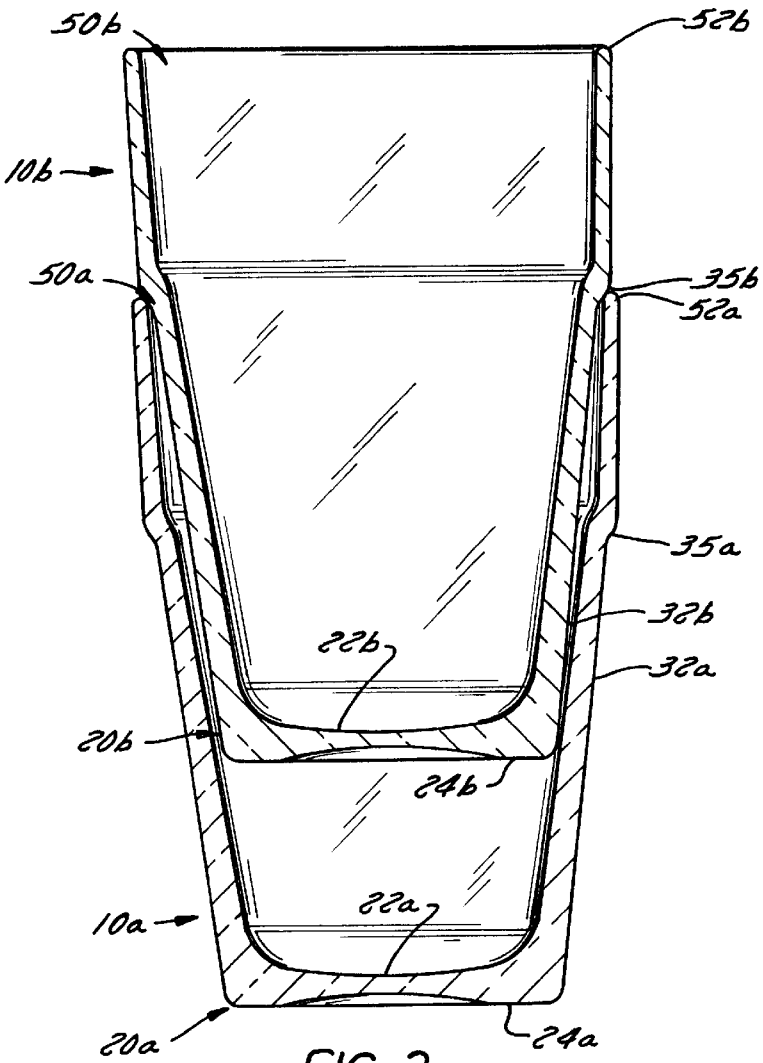
FIG. 3 is a schematic, vertical sectional side view showing two stacked tumblers of FIG. 1.

A stack of two such tumblers 10 is shown in FIG. 3, where the lower tumbler is designated 10*a* and the upper tumbler is designated 10*b*. As can be seen in FIG. 3, the only point of contact between the two tumblers 10*a* and 10*b* is between the rim 52*a* of the mouth 50*a* of the lower tumbler 10*a* with the outside of the shoulder 36*b* of the second tumbler 10*b*. The lengths of the first and second side wall portions 32 and 38, respectively, and the first and second angles, and the size of the rim 52 and the shoulder 35 are all selected so that when an upper tumbler 10*b* of like configuration is resting upon the rim 52*a* of the mouth 50*a* of a lower tumbler 10*a*, the outer surface of the first side wall portion 32*b* of the upper tumbler 10*b* will not contact the inner surface of the lower tumbler 10*a* when the upper tumbler 10*b* is stacked substantially coaxially within the lower tumbler 10*a*.

The horizontal cross-section of the tumbler 10 is preferably generally circular, although other configurations, such as oval, are also envisioned.

The thickness of the side wall 30 and bottom 20 of the tumbler 10 may the same throughout, or may vary. Preferably, the thickness of the bottom 20 is greater than that of the side wall 30. Preferably also, the thickness of the side wall 30 gradually increases in a downwardly direction from the mouth 50 to the bottom 20, but in no place is it greater than the thickness of the bottom 20. In this case, the first angle of the outer surface will be less than the first angle of the inner surface for the first side wall portion 32, and the second angle of the outer surface will be less than the second angle of the inner surface for the second side wall portion 38. However, both the second are less than the both of the first angles, so that overall the second side wall portion 38 is more nearly perpendicular than is the first side wall portion 32.

Any two adjacent sections of the tumbler 10, although preferably formed integrally, may be considered to be joined at an edge between the two sections. Any or all edges, such as the rim 52 of the mouth 50 or at the upper and lower edges 36 and 37 of the shoulder 35 are preferably gently rounded as shown in FIG. 2.

The resulting glass tumbler has a good overall height, and yet stacks to a low height. In addition, the stack is quite stable and is enhanced by a thicker bottom. Furthermore, there is little interior glass contact when the tumblers are stacked. This low level of interior glass contact results in decreased damage or breakage.

Finally, the constant angles of the first and second wall portions, 32 and 38, respectively, result in substantially straight inner and outer surfaces of these portions of the tumbler wall. This results in an aesthetically pleasing glass tumbler, with a new look with very clean lines.

Figure 4:
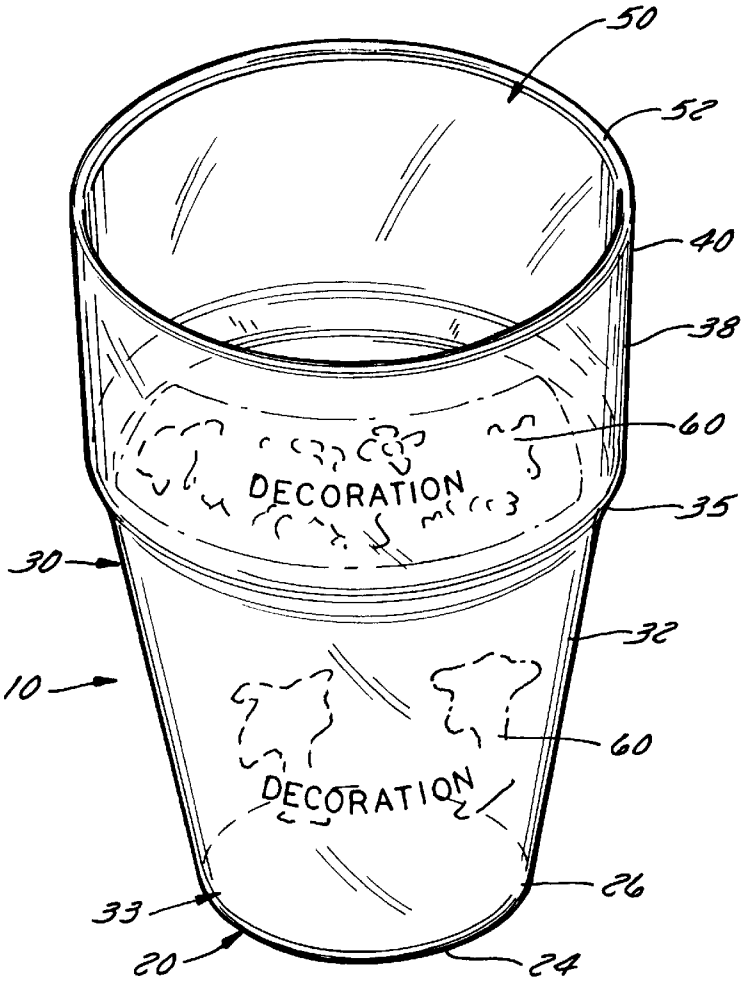
FIG. 4 is a perspective view of a second embodiment of a stackable glass tumbler of the invention and showing application of decorative material to the straight side wall thereof.

In one embodiment, the inner and outer surfaces of the first and second side wall portions 32 and 38 are substantially smooth. In another embodiment, the inner or outer surfaces, or both, of the first or second side wall portions 32 and 38, or both, may be decorated, as is shown schematically in FIG. 4. The use of such decoration is facilitated by the substantially straight inner and outer surfaces of the side wall 30, which make it easier to decorate the surfaces. Thus, either the inner or outer surface, or both surfaces, of the first and second side wall portions 32 and 38, respectively, of the side wall 30 may contain printed material or other images or designs imprinted or otherwise affixed thereto. Such material is generally referred to as decorative material 60. Preferably, the decorative material 60 is visible when the tumbler 10 is in use. Such decorative material 60 may comprise, for example, logos, trade names, or other advertising slogans. Alternatively, such decorative material 60 may comprise humorous or aesthetic designs, such as cartoon characters or floral scenes. Such decorative material 60 may further or in addition comprise bold or bright or "designer" colors, or other material which attracts or is designed to attract the attention of the user. Such decorative material 60 may comprise sparkling or glittering substances, or fluorescent material.

Figure 5:
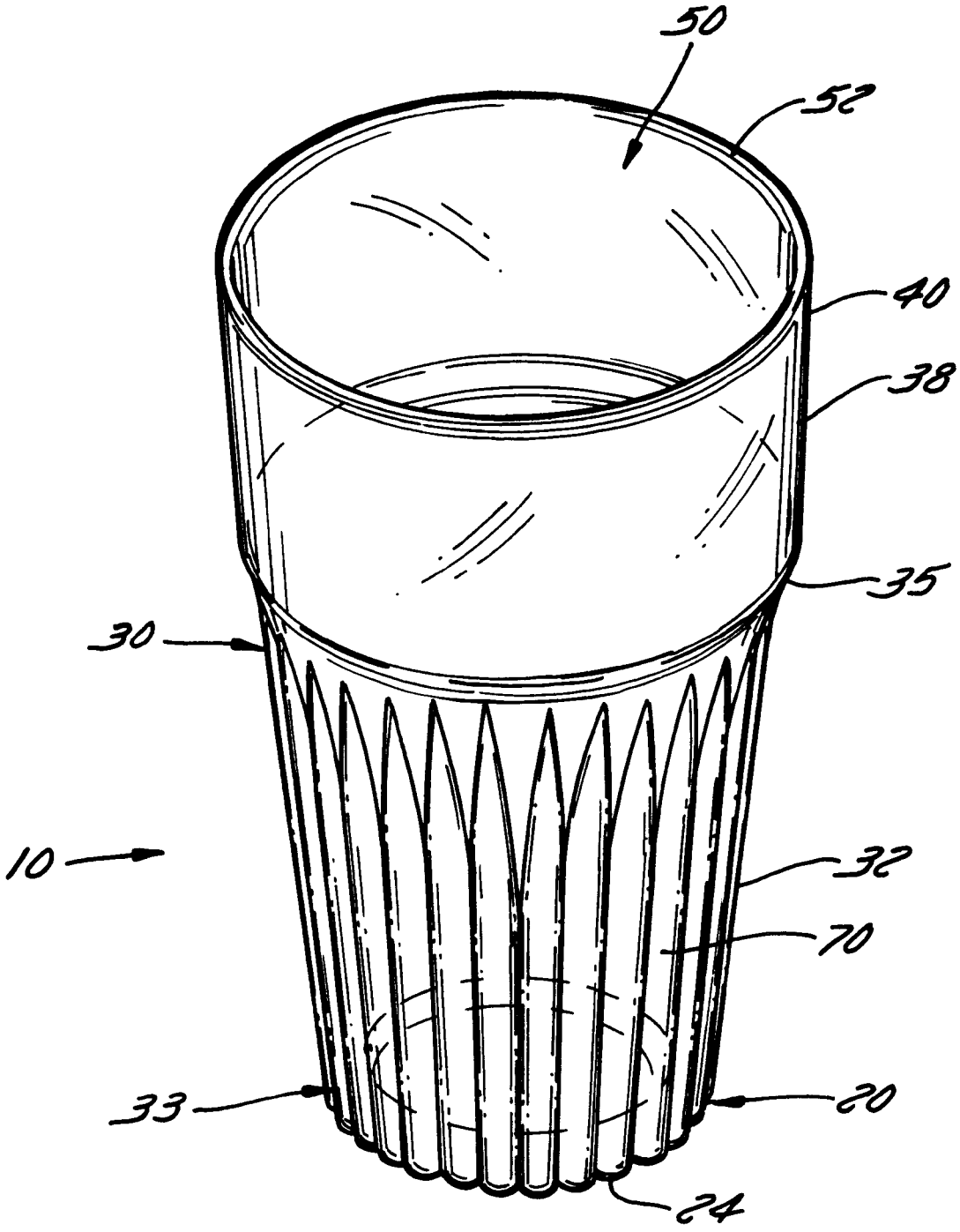
FIG. 5 is a perspective view of a second embodiment of a stackable glass tumbler of the invention and showing a three dimensional surface design in the straight side wall thereof.

In yet another embodiment, the surface of the side wall 30 comprises a three dimensional surface design 70, as is shown schematically in FIG. 5. Preferably, the design is located on the outer surface of the side wall 30, and most preferably, the design is located on the first side wall portion 32. The design may be formed as an integral part of the side wall 30, and it may be formed during formation of the tumbler 10, such as by molding, or it may be cut or etched into the surface of the side wall 30 after formation of the tumbler 10. Preferably, the design consists essentially of grooves or clefts or flutes in a longitudinal direction on the outer surface of the first side wall portion 32. Such a design aids in gripping the glass tumbler during use while retaining good side wall strength, yet does not interfere with the improved stacking capability of the tumblers.

The glass tumbler may be any size which is suitable for drinking. Typical sizes are 6 oz., 9 oz., 12 oz., 16 oz. or 20 oz.; these measurements are industry standards to indicate the volume of fluid contents which the tumbler can conveniently accommodate. Furthermore, the glass tumbler may comprise clear, colorless glass, or may comprise glass which is tinted or opaque, as is well known in the art.

In a typical preferred embodiment, in which the size of the glass tumbler is 9 oz., the horizontal cross-section of the tumbler 10 is generally circular, the thickness of the side wall 30 gradually increases in a downwardly direction from the mouth 50 to the bottom 20, the inner surface and the outer surface of the side wall 30 are smooth, the first angle of the outer surface of the first side wall portion 32 is about 11.3 degrees, the first angle of the inner surface of the first side wall portion 32 is about 12.3 degrees, the second angle of the outer surface of the second side wall portion 38 is about 3 degrees, and the second angle of the inner surface of the second side wall portion 38 is about 6 degrees.

It is understood that this invention is not confined to the particular embodiments illustrated and described above, but embraces such modified forms thereof as come within the scope of the following claims.

What is claimed is:

1. A stackable glass tumbler, comprising (a) a bottom having an inner and outer surface and a radial edge; and (b) a side wall comprising:

(i) a first side wall portion of a first length extending upwardly and radially outwardly from the radial edge of the bottom at a first constant angle such that a lower end of the first side wall portion adjacent the bottom has a smaller diameter than an upper end of the first portion;

(ii) a shoulder extending radially outwardly from the upper end of the first side wall portion such that a lower end of the shoulder adjacent to the upper end of the first side wall portion has a smaller diameter than an upper end of the shoulder; and (iii) a second side wall portion of a second length which is less than the first length extending upwardly and radially outwardly from the upper end of the shoulder at a second constant angle which is less than the first constant angle such that a lower end of the second side wall portion adjacent the shoulder has a smaller diameter than an upper end of the second side wall portion which defines an open mouth of the glass tumbler; and wherein the mouth includes a rim adapted to engage the shoulder of a like configured glass tumbler stacked therewithin such that an outer surface of the first side wall portion of the like configured glass tumbler will not contact an inner surface of the first or second side wall portions of the like configured glass tumbler when stacked coaxially therewith.

2. A tumbler according to claim 1, wherein the second length is about less than or equal to about one half of the first length.

3. A tumbler according to claim 1, wherein the second length is about 34% of a total length of the side wall.

4. A tumbler according to claim 1, wherein the first angle is in the range of about 7 to 13 degrees.

5. A tumbler according to claim 4, wherein the first angle is about 7 degrees.

6. A tumbler according to claim 1, wherein the second angle is in the range of about 2 to 6 degrees.

7. A tumbler according to claim 6, wherein the second angle is about 2 degrees.

8. A tumbler according to claim 1, wherein the tumbler is generally circular in horizontal cross section.

9. A tumbler according to claim 1, wherein the bottom has a thickness which is greater than any thickness of the side wall.

10. A tumbler according to claim 1, wherein the thickness of the side wall gradually increases in a downwardly direction from the mouth to the bottom.

11. A tumbler according to claim 1, wherein the second length is about one half of the first length, the first angle is in the range of about 7 to 13 degrees, the second angle is in the range of about 2 to 3 degrees, and the thickness of the side wall portions increase in a downwardly direction from the mouth to the bottom, and the thickness of the bottom is greater than the thickness of the side wall.

12. A tumbler according to claim 1, wherein the inner surface and the outer surface of the side wall are substantially smooth.

13. A tumbler according to claim 1, wherein the side wall further includes decorative material applied to at least one of the inner or the outer surface of at least one of the first portion or the second portion of the side wall.

14. A tumbler according to claim 1, wherein the side wall further includes a three dimensional surface design.

15. A tumbler according to claim 11, wherein the inner and the outer surface of the side wall is substantially smooth.

16. A tumbler according to claim 11, wherein the side wall further includes decorative material applied to at least one of the inner or the outer surface of at least one of the first portion or the second portion of the side wall.

17. A tumbler according to claim 11, wherein the side wall further includes a three dimensional surface design.

* * * * *